US005886605A

United States Patent [19]

Ulerich et al.

[11] Patent Number: 5,886,605

[45] Date of Patent: Mar. 23, 1999

[54] ACTUATOR ASSEMBLY WITH CALIBRATION MEANS AND ELECTRICAL POWER SWITCH APPARATUS INCORPORATING THE ACTUATOR ASSEMBLY WITH CALIBRATION MEANS

[75] Inventors: Phillip L. Ulerich, Pittsburgh; John A. Wafer, Beaver, both of Pa.

[73] Assignee: Eaton Corporation, Cleveland, Ohio

[21] Appl. No.: 74,098

[22] Filed: May 7, 1998

[51] Int. Cl.[6] ..... H01H 9/00

[52] U.S. Cl. ..... 335/172; 335/167; 335/253

[58] Field of Search ..... 335/167–76, 177–179, 335/219, 220, 227, 229, 230, 234, 237, 258, 273, 251, 253, 255

[56] References Cited

U.S. PATENT DOCUMENTS 5,162,765 11/1992 DiVincenzo et al. ..... 335/175
5,453,724 9/1995 Seymour et al. ..... 335/172
5,503,366 4/1996 Zabeck et al. ..... 251/129.18

*Primary Examiner*—Lincoln Donovan
*Attorney, Agent, or Firm*—Martin J. Moran

[57] ABSTRACT

An actuator assembly for an electrical power switch apparatus, the actuator assembly having a housing and a plunger positioned within the housing where the plunger is movable between a set position and an actuated position. The plunger includes a compression spring to provide a pre-load thereto that biases the plunger away from the set position and toward the actuated position. A magnet contained in the housing and positioned proximate to the plunger establishes a magnetic force which overcomes the pre-load of the compression spring and maintains the plunger in a set position. A coil assembly, that when energized, produces an electromagnetic force which bucks the magnetic force established by the magnet allowing the plunger to be propelled by the compression spring to the actuated position. A screw extends through an opening in the plunger for engagement with the compression spring so that rotation of the screw results in the adjustment or calibration of the pre-load of the compression spring.

10 Claims, 2 Drawing Sheets

ACTUATOR ASSEMBLY WITH CALIBRATION MEANS AND ELECTRICAL POWER SWITCH APPARATUS INCORPORATING THE ACTUATOR ASSEMBLY WITH CALIBRATION MEANS

BACKGROUND OF THE INVENTION

1. Field of the Invention

The invention relates generally to electrical power switch apparatuses, and more particularly, to an actuator assembly thereof that can be calibrated.

2. Background Information

Several types of electrical power switch apparatuses, such as, circuit breakers, transfer switches, and disconnect switches are known. Such apparatuses include an operating mechanism, typically actuated by an actuator assembly, for opening the switch. For example, an actuator assembly used in conjunction with a circuit breaker interacts with the operating mechanism to separate the circuit breaker contacts upon occurrence of an overcurrent condition within a protected electrical distribution system.

Actuator assemblies, such as utilized in conjunction with circuit breakers, are generally known. For certain known circuit breakers, the actuator assembly receives a pulse electrical signal from an electronic trip unit to actuate the operating mechanism. The signal is usually a low power signal due to the limited power available from the electronic trip unit. Therefore, it is important that the actuator assembly consistently be actuated by the low power signal to insure proper operation of the actuator assembly and the circuit breaker. However, this becomes increasingly difficult in view of manufacturing variations inherent in the manufacturing processes of the actuator assembly components. Particularly because slight manufacturing variations, such as, for example, surface roughness of the holding magnet and armature, directly affect the magnitude of the low power signal needed to actuate the actuator assembly.

U.S. Pat. No. 5,453,724 sets forth an actuator assembly. This assembly employs a holding magnet to retain an armature against the propelling bias of a compression spring. A coil assembly circumferentially disposed about the armature receives a pulse electrical signal which bucks the magnetic force provided by the holding magnet and releases the armature.

There is a need, therefore, for an electrical power switch apparatus having an improved actuator assembly.

There is also a need for an electrical power switch apparatus having an actuator assembly that is consistently actuated by a pulse electrical signal.

There is a further need for an electrical power switch apparatus having an actuator assembly that accounts for manufacturing variations of the actuator assembly components to assure consistent actuation of the actuator assembly.

SUMMARY OF THE INVENTION

These and other needs are satisfied by the invention which is directed to an improved actuator assembly for an electrical power switch apparatus. The actuator assembly includes a housing formed of a magnetically permeable material and a plunger positioned within the housing that is movable between a set position and an actuated position. The plunger is also formed of a magnetically permeable material. The actuator assembly further includes a biasing means, preferably a compression spring, having a pre-load for biasing the plunger. The compression spring biases the plunger away from the magnet and the set position, and toward the actuated position. A magnet means, such as a conventional permanent magnet, is contained in the housing and positioned proximate to the plunger. The magnet establishes a magnetic force which overcomes the pre-load provided by the compression spring and maintains the plunger in the set position. The actuator assembly further includes a coil assembly that when energized produces an electromagnetic force which bucks the magnetic force established by the magnet allowing the plunger to be moved or propelled by the compression spring to the actuated position.

The actuator assembly also includes calibration means which advantageously allows for calibrating the pre-load of the compression spring. As can be appreciated, the amount of pre-load on the compression spring is directly related to the magnetic force established by the magnet which overcomes the pre-load and maintains the plunger in the set position. The pre-load of the compression spring and the magnetic force established by the magnet are in turn directly related to the amount of energy needed for energizing the coil assembly and bucking the magnetic force established by the magnet. The pre-load of the compression spring may be calibrated or adjusted in accordance with the amount of energy that is available for energizing the coil assembly. This is particularly advantageous when there is a limited or set amount of energy available for energizing the coil assembly.

In the preferred embodiment, the compression spring is contained within a bore formed along a longitudinal axis of the plunger. An opening is provided adjacent a first end of the plunger that leads to the bore, while the second end of the plunger is positioned proximate to the magnet. The calibration means, which is preferably a threaded screw or similar means, is preferably threadedly received in the opening. The screw extends through the opening for engaging the compression spring such that rotation of the screw results in the adjustment of the pre-load of the compression spring to provide for the calibration.

The invention also includes an electrical power switch apparatus, such as a circuit breaker, incorporating the actuator assembly.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENT

The present invention is directed toward an actuator assembly for an electrical power switch apparatus, such as, for example, a circuit breaker, a transfer switch, a disconnect switch, or other similar types as is known. For purposes of illustration, the invention will be described in relation to a circuit breaker.

Figure 1:
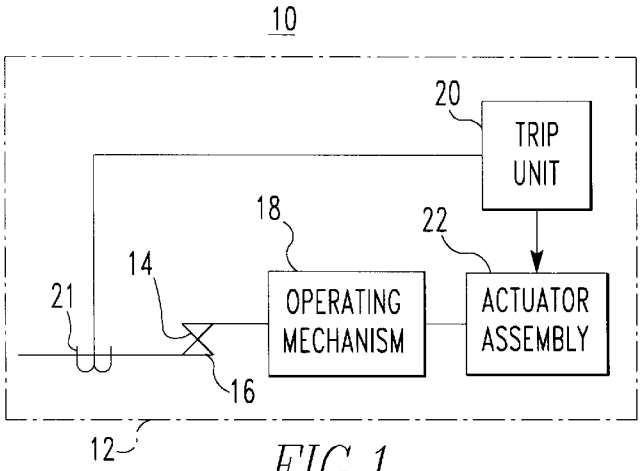
FIG. 1 is a schematic illustration of a circuit breaker employing an actuator assembly of the invention.

Referring to FIG. 1, there is shown a circuit breaker 10 with selected components thereof schematically illustrated.

The circuit breaker 10 comprises an electrically insulative housing 12 and separable electrical contacts 14 and 16 disposed within the housing 12 and movable between a closed position and an open position. The circuit breaker 10 also includes an operating mechanism 18 for closing, opening and tripping open the contacts 14 and 16, and a trip unit 20 which acts responsive to current flowing in the protected circuit as sensed by a current transformer 21. The trip unit 20 is capable of generating a trip signal in response to a predetermined electrical condition, such as an overcurrent. The circuit breaker 10 also includes an actuator assembly 22 that is operatively connected to the operating mechanism 18. The actuator assembly 22 receives the trip signal 20 and actuates the operating mechanism 18 to trip open the contacts 14 and 16.

Figure 2:
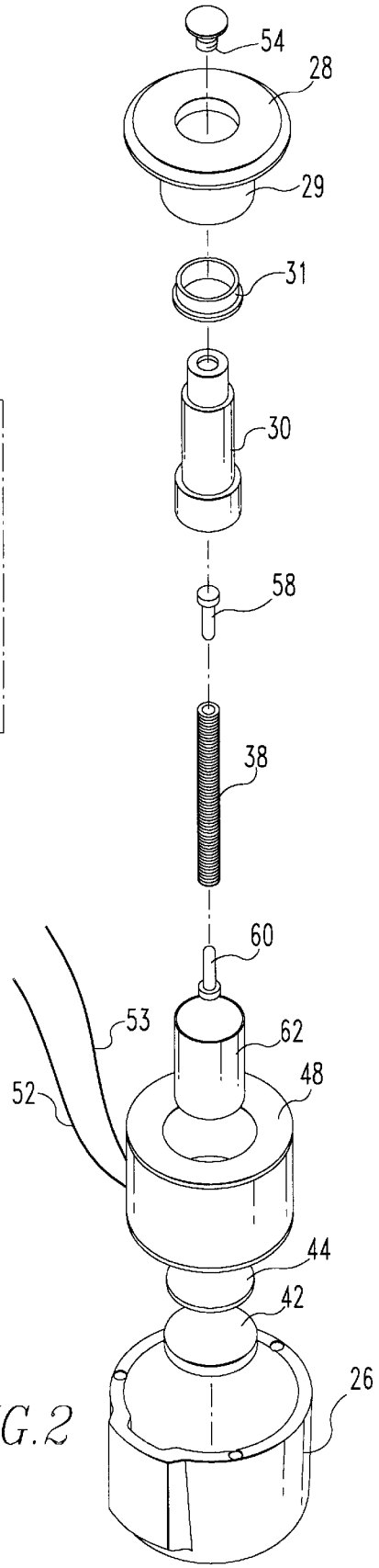
FIG. 2 is an exploded isometric view of the actuator assembly of the invention.
Figure 3:
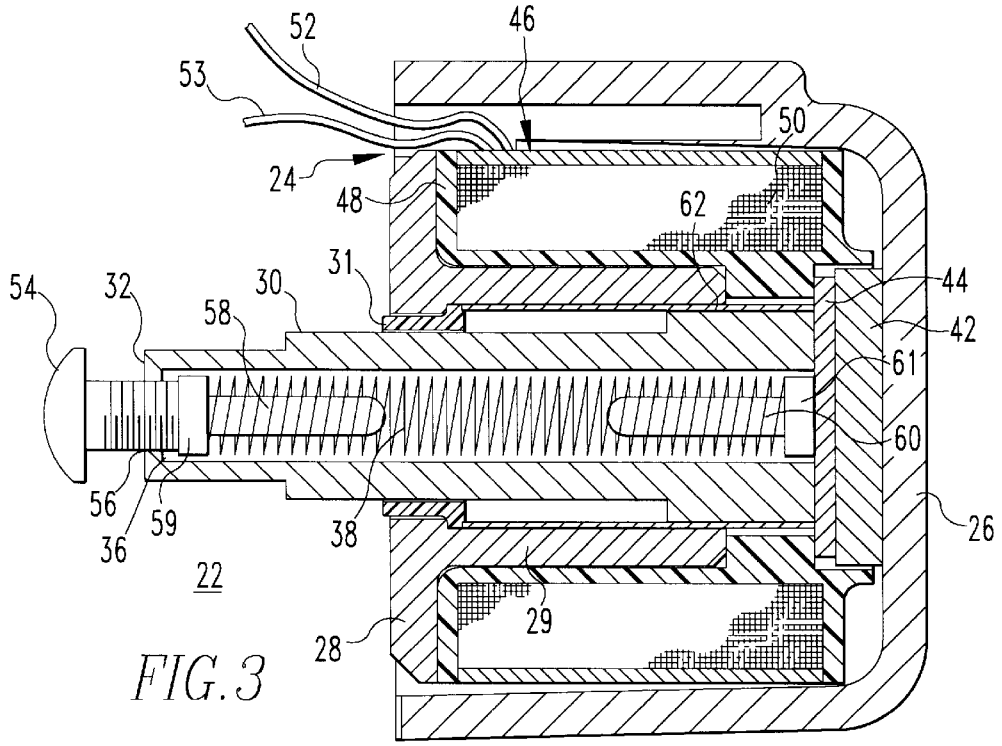
FIG. 3 is a sectional view of the actuator assembly in a set position.
Figure 4:
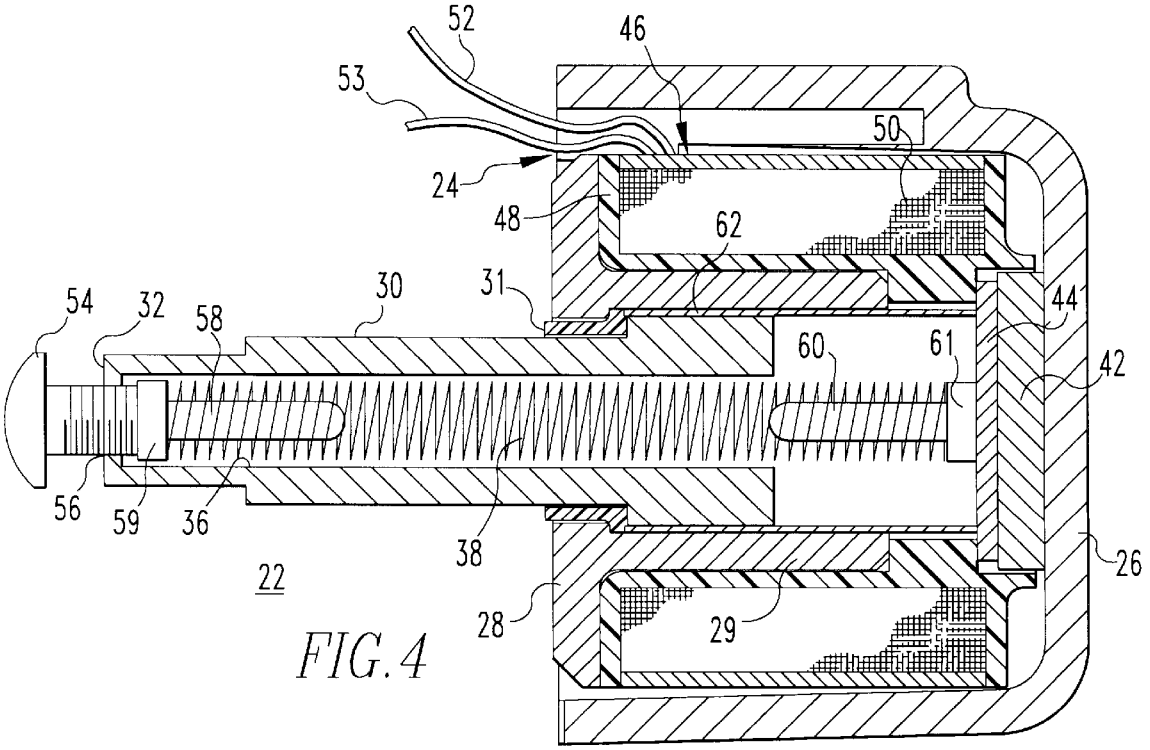
FIG. 4 is a sectional view of the actuator assembly in an actuated position.

Referring to FIGS. 2–4, there is shown a preferred embodiment of the actuator assembly 22 of the invention. The actuator assembly 22 includes a housing, generally designated by reference numeral 24, formed of a magnetically permeable material. The housing 24 may be constructed as a single piece, but preferably comprises a base container 26 shaped in the form of a cup and a cover 28 for enclosing the open portion of the base container 26. The cover is attached to the base container 26 by, for example, crimping the base container 26 to the cover 28 at spaced intervals about the circumference of the base container 26. While the base container 26 and cover 28 may be adjoined by other known forms of metal working besides crimping, it is important that these components which make up the housing 24 maintain the ability to support a flux path, as will be described herein.

The actuator assembly 22 further includes a plunger 30 partially contained within the housing 24. The plunger 30 is also formed of a magnetically permeable material. The plunger 30 includes a first end 32 which preferably extends from the housing 24 and a second, larger diameter end 34 contained within the housing 24. The plunger 30 is movable between a set position (FIG. 3) and an actuated position (FIG. 4).

The plunger 30 includes a bore 36 extending along a longitudinal axis thereof. Contained within the bore 36 is a compression spring 38, having a pre-load, that biases or urges the plunger 30 away from the set position and toward the actuated position.

The actuator assembly 22 also includes a permanent magnet 42 contained within the housing 24 and positioned proximate to the second end 34 of plunger 30. Positioned between the magnet 42 and the second end 34 of plunger 30 is a metal disk 44. The metal disk 44 is preferably formed of a material, such as, for example, steel or similar magnetically permeable material. The metal disk 44 is preferably formed of a material that is less brittle than the magnet 42 to act as a buffer between the second end 34 of plunger 30 and the magnet 42. The metal disk 44, being formed of a tougher material, absorbs the impact of the plunger 30 as it moves between the set and actuated position. This prevents excessive wear or breakage of the magnet 42.

The magnet 42 is positioned within the housing 24 to establish a magnetic force which overcomes the biasing force of the compression spring 38 to maintain the plunger 30 in the set position. Specifically, the magnet 42 establishes a flux path, as indicated by arrows M, which extends from the magnet 42 through the base container 26 to the cover 28 and through a cylindrical, depending leg portion 29 of the cover 28 and into the second end 34 of the plunger 30. A bushing 31, formed of a non-magnetically permeable material, is positioned between the cover 28 and the plunger 30 to direct the flux path through leg portion 29 prior to the flux path entering plunger 30 at the second end 34 thereof. The end of leg portion 29 closest to the second end 34 of plunger 30 is spaced from the bottom wall of base container 26 so that flux is diverted through the second end 34 of the plunger 30 to hold the plunger 30 against the metal disk 44. The bushing 31 also provides lateral support to plunger 30.

The actuator assembly 22 further includes a coil assembly 46 having an electrically insulative bobbin 48 and a coil 50 wound thereabout, as is generally known. Leads 52 and 53 extend from the trip unit 20 and into the housing 24 of the actuator assembly 22. The leads 52 and 53 supply a pulse signal that energizes the coil assembly 46 creating an electromagnetic field of sufficient force to buck the magnetic force established by the magnet 42. Thus, by energizing the coil assembly 46 and bucking the magnetic force established by magnet 42, the plunger 30 is able to move away from the metal disk 44 and move to the actuated position. This occurs due to the pre-load of the compression spring 38 biasing or propelling the plunger 30 toward the actuated position once the biasing force of the compression spring 38 is sufficient to overcome the magnetic force that remains following the bucking of the same by the electromagnetic force created by the coil assembly 46.

Thus, it will be appreciated that the biasing force of the compression spring 38 due to the pre-load placed thereon, the magnitude of the electromagnetic force created by coil assembly 46, and the magnitude of the magnetic force established by magnet 42 are directly related and directly effect when the plunger 30 will move from the set position to the actuated position. First, the magnetic force established by magnet 42 must be strong enough to overcome the biasing force of the compression spring 38 and maintain the plunger 30 in the set position. The pulse signal provided by leads 52 and 53 to the coil assembly 46 must then be able to sufficiently energize the coil assembly 46 to establish an electromagnetic force that is strong enough to buck the magnetic force established by magnet 42. While the electromagnetic force created by coil assembly 46 does not need to be larger than the magnetic force provided by the magnet 42, the electromagnetic force created by the coil assembly 46 merely needs to sufficiently buck the magnetic force of magnet 42 to allow the biasing force of the compression spring 38 to overcome the resultant magnetic force and move from the set position to the actuated position.

As is normally the case, the magnitude of the magnetic force provided by magnet 42 is fixed and cannot be varied once assembled within the housing 24, particularly when magnet 42 is a permanent magnet. In addition, the magnitude of the pulse signal carried by lead 52 to energize the coil assembly 46 is typically fixed and cannot be varied. For example, in the circuit breaker 10, the trip unit 20 typically has a limited power source available for use. This in turn means that there is a limited amount of power available to generate the pulse signal to be sent through leads 52 and 53 to energize the coil assembly 46. With the magnetic force established by magnet 42 and the electromagnetic force created by coil assembly 46 essentially being constant, it is important that the plunger 30 be able to function properly within the given parameters of the magnet 42 and coil assembly 46. Specifically, the pre-load of the compression spring 38 needs to be set so that there is sufficient pre-load to bias or propel the plunger 30 from the set position to the actuated position following the coil assembly 46 being energized to buck the magnetic force of magnet 42. If the pre-load of the compression spring 38 is too low, then the plunger 30 may not move from the set position to the actuated position following the coil assembly 46 being energized. If the pre-load of the compression spring 38 is too high, then obviously the plunger 30 will move to the actuated position once the coil assembly 46 is energized. But, with the pre-load of the compression spring 38 set too high, the plunger 30 may move to the actuated position when it is not supposed to. For example, vibration within the circuit breaker 10 may cause the actuator assembly 22 to "shock-out".

In order to achieve an actuator assembly 22 that operates properly and within the constraints described herein, the actuator assembly 22 may be designed with those constraints being taken into consideration. However, manufacturing variations in the individual components which make up the actuator assembly 22 still make it difficult to obtain a properly functioning actuator assembly 22. For example, the surface finish of the magnet 42, the metal disk 44 and the first end 34 of plunger 30, all of which directly abut as shown in FIGS. 3 and 4, has a direct effect on the operation of the actuator assembly 22. If the surface finish of these components is smooth, i.e., having a continuously even surface, then the magnetic force supplied by magnet 42 holds these components more tightly together. On the other hand, as the surface finish of these components becomes rougher or less smooth, then these components are not held together as tightly. Therefore, a smoother surface finish and tighter bond between the magnet 42, metal disk 44 and plunger 30, requires a larger electromagnetic force from the coil assembly 46 to buck the magnetic force of magnet 42. However, as described, the electromagnetic force typically cannot be varied because of the pulse energy being fixed or constant.

To overcome the described manufacturing variations and in accordance with an important aspect of the invention, the pre-load of the compression spring 38 may be adjusted or calibrated accordingly. For example, the pre-load of the compression spring 38 may be increased for the situation where actuator assembly 22, as manufactured and assembled, requires a pulse signal that is larger than the trip unit 20 may be able to supply to energize the coil assembly 46. Increasing the pre-load of the compression spring 38 would result in a pulse signal of lower magnitude being required to cause actuation. Conversely, the pre-load of the compression spring 38 may be decreased for the situation where the previously described problem of "shock-out" is occurring.

To calibrate the pre-load of the compression spring 38, the invention includes a screw 54, or similar means, threadedly received in an opening 56 formed in the first end 32 of the plunger 30. The screw 54 engages, directly or indirectly, the compression spring 38. Rotation of the screw 54 results in the adjustment of the pre-load of compression spring 38 to achieve calibration thereof. For example, rotation of screw 54 in a first direction will result in the pre-load of compression spring 38 being increased. Rotation of the screw 54 in a second direction, generally opposite to the first direction, would result in the pre-load of the compression spring 38 being decreased.

A spring guide, such as first pin 58, may be inserted longitudinally within the compression spring 38 to provide lateral support thereto during expansion and compression. The head 59 of pin 68 may be positioned between the screw 54 and the compression spring 38. Advantageously, this provides a bearing surface which acts between the screw 54 and compression spring 38 when rotating screw 54 to adjust or calibrate the pre-load of compression spring 38. Similarly, pin 60 may also provide lateral support to compression spring 38, where pin 60 may include a head 61 which provides a bearing surface acting between the compression spring 38 and the metal disk 44. Advantageously, heads 59 and 61 prevent excessive wear of the compression spring 38 thereby increasing the life of the actuator assembly 22.

The actuator assembly 22 may also include a sleeve 62 circumferentially positioned between the plunger 30 and the leg portion 29 of cover 28 to reduce friction therebetween during movement of the plunger 30 from the set position to the actuated position.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. An actuator assembly for an electrical power switch apparatus, said actuator assembly comprising:

a magnetically permeable housing;

a magnetically permeable plunger positioned in said housing and moveable between a set position and an actuated position;

biasing means having a pre-load, said biasing means biasing said plunger away from said set position toward said actuated position;

magnet means contained in said housing and positioned proximate to said plunger, said magnet means establishing a magnetic force which overcomes said pre-load of said biasing means and maintains said plunger in said set position;

a coil assembly that when energized produces an electromagnetic force which bucks said magnetic force established by said magnet means allowing said plunger to be moved by said biasing means to said actuated position;

calibration means for calibrating the pre-load of said biasing means;

wherein said biasing means is a compression spring, said calibration means engaging said compression spring to calibrate the pre-load of said compression spring; and wherein said plunger includes a first and second end, said second end positioned proximate to said magnet means, said plunger further including a bore extending along a longitudinal axis of said plunger, said plunger having an opening adjacent said first end that leads to said bore, said compression spring contained within said bore and said calibration means extending through said opening for engaging said compression spring to calibrate the pre-load of said compression spring.

2. An electrical power switch apparatus comprising:

separable electrical contacts;

an operating mechanism for operating said electrical contacts; and an actuator assembly comprising:

a magnetically permeable material housing;

a magnetically permeable plunger positioned in said housing and moveable between a set position and an actuated position for actuating said operating mechanism;

biasing means having a pre-load, said biasing means biasing said plunger away from said set position toward said actuated position;

magnet means contained in said housing and positioned proximate to said plunger, said magnet means establishing a magnetic force which overcomes said pre-load of said biasing means and maintains said plunger in said set position;

a coil assembly that when energized produces an electromagnetic force which bucks said magnetic force established by said magnet means allowing said plunger to be moved by said biasing means to said actuated position;

calibration means for calibrating the pre-load of said biasing means;

wherein said biasing means is a compression spring, said calibration means engaging said compression spring to calibrate the pre-load of said compression spring; and wherein said plunger includes a first and second end, said second end positioned proximate to said magnet means, said plunger further including a bore extending along a longitudinal axis of said plunger, said plunger having an opening adjacent said first end that leads to said bore, said compression spring contained within said bore and said calibration means extending through said opening for engaging said compression spring to calibrate the pre-load of said compression spring.

3. The actuator assembly of claim 1 wherein said calibration means includes a screw means threadedly received in said opening, rotation of said screw means resulting in the calibration of the pre-load of said compression spring.

4. The actuator assembly of claim 3 further including a first spring guide means for providing lateral support to said compression spring along a longitudinal axis thereof, said first spring guide means positioned adjacent said first end of said plunger and between said screw means and said compression spring.

5. The actuator assembly of claim 4 further including a second spring guide means for providing lateral support to said compression spring along a longitudinal axis thereof, said second spring guide means positioned adjacent said second end of said plunger and between said compression spring and said magnet means.

6. The actuator assembly of claim 5 further including a sleeve circumferentially positioned between said plunger and said housing to reduce friction therebetween during movement of said plunger.

7. The apparatus of claim 2 wherein said calibration means includes a screw means threadedly received in said opening, rotation of said screw means resulting in the calibration of the pre-load of said compression spring.

8. The apparatus of claim 7 further including a first spring guide means for providing lateral support to said compression spring along a longitudinal axis thereof, said first spring guide means positioned adjacent said first end of said plunger and between said screw means and said compression spring.

9. The apparatus of claim 8 further including a second spring guide means for providing lateral support to said compression spring along a longitudinal axis thereof, said second spring guide means positioned adjacent said second end of said plunger and between said compression spring and said magnet means.

10. The apparatus of claim 9 further including a sleeve circumferentially positioned between said plunger and said housing to reduce friction therebetween during movement of said plunger.

* * * * *